US005138812A

United States Patent [19]

Palmersten

[11] Patent Number: 5,138,812

[45] Date of Patent: Aug. 18, 1992

[54] CABANA PANELS HAVING SNAP LOCKING MEANS

[76] Inventor: Michael J. Palmersten, 3110 Hillside La., Saftey Harbor, Fla. 34695

[21] Appl. No.: 746,843

[22] Filed: Aug. 19, 1991

[51] Int. Cl.[5] ..... E04B 1/82

[52] U.S. Cl. ..... 52/584; 52/309.9; 52/588; 52/595

[58] Field of Search ..... 52/309.9, 588, 595, 52/584, 471, 593

[56] References Cited

U.S. PATENT DOCUMENTS

| | | | |
|---|---|---|---|
| 2,449,292 | 9/1948 | Gillet et al. | 52/593 |
| 3,282,613 | 11/1966 | Axelsonn | 52/584 |
| 3,327,447 | 6/1967 | Nissley | 52/593 |
| 4,433,514 | 2/1984 | Henges, Jr. et al. | 52/588 |
| 4,437,287 | 3/1984 | Halfaker | 52/588 |

*Primary Examiner*—David A. Scherbel
*Assistant Examiner*—Wynn Wood
*Attorney, Agent, or Firm*—Joseph C. Mason, Jr.; Ronald E. Smith

[57] ABSTRACT

Modular building panels having foam cores protected by metal skins are releasably interconnected in edge-to-edge relation to one another. Each panel has a first panel edge that is flat and a second edge with a pair of parallel grooves formed in it. The interconnection is accomplished by bending the metal skins that protect the top and bottom surfaces of the core so that contiguous panels are snap fit together when the bent metal skins are interlocked with one another. The interlocking skin associated with a first panel edge has a "J" shape and extends outwardly at a forty five degree angle relative to the edge of that panel. The skin associated with a second panel is bent into a ladle shape that includes a cup that receives the curved end of the "J"-shaped part when the panels are interconnected. Each ladle-shaped part extends into its associated groove at a forty five degree angle, in a reverse direction relative to the "J"-shaped part. Both the "J"-shaped part and the ladle-shaped part are yieldable and resilient and the common angular orientation between them enables facile interconnection of contiguous panels.

6 Claims, 3 Drawing Sheets

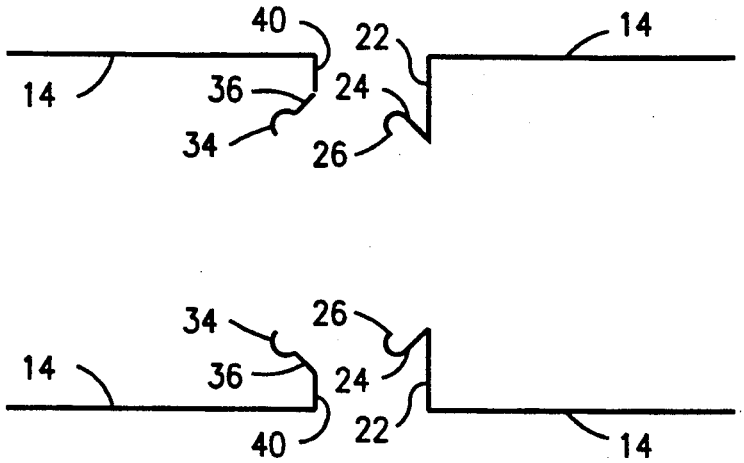
Fig. 3
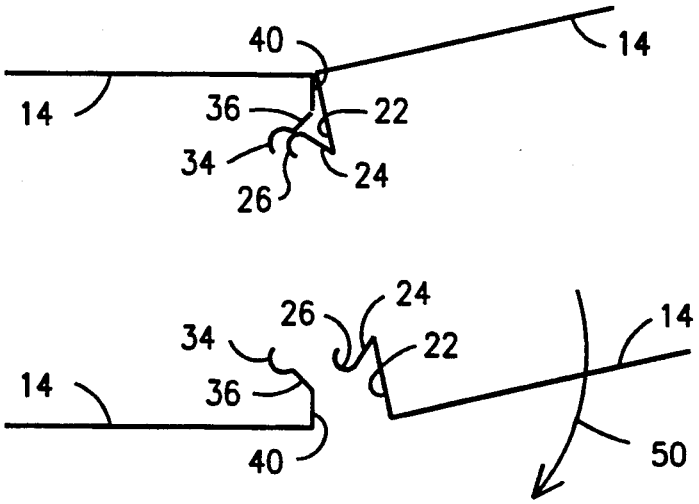
Fig. 4
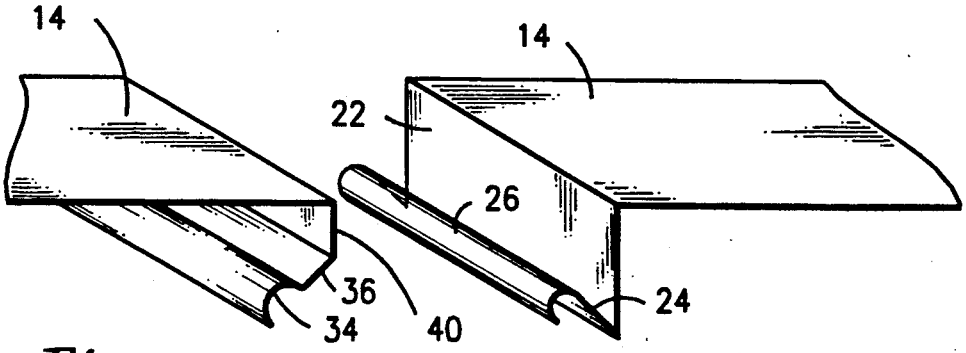
Fig. 6
Fig. 5

CABANA PANELS HAVING SNAP LOCKING MEANS

TECHNICAL FIELD

This invention relates to modular cabana panels of the type having metal skins that cover the top and bottom of an expanded polystyrene core. More particularly, it relates to a snap lock design that facilitates the construction of a roof with said panels.

BACKGROUND ART

Roofs made of expanded polystyrene (EPS) modular panels are popular in the construction industry because they insulate well, are light in weight, and are easy to install because of their modular form.

EPS is a soft, easily damaged material. Accordingly, the top and bottom faces of the EPS core are usually covered by a thin skin of sheet metal; the sheet metal is bonded to the core by a suitable adhesive means. The metal sheets protect the core from abrasion and, advantageously, contiguous edges thereof may be bent into complementally interlocking forms to provide a means for interlocking abutting sections of the panels.

In many designs, the EPS core is also sculpted to provide supplemental locking means. In those designs, a groove may be formed in the edge of one panel and a corresponding tongue may be formed in the edge of an abutting panel. Thus, in a typical roof made of interlocked modular panels of the metal skin-covered EPS type, both the abutting foam cores and the contiguous metal skins will be interlocked with one another.

All of the designs are intended to facilitate the interlocking of the panels at the time the roof is laid down, and to provide as near a seamless fit as possible to inhibit to the greatest extent possible the intrusion of moisture into the space between the panels. However, most contractors use a caulking compound to seal the seam between the panels, regardless of how tightly fit together the contiguous interlocking panels are believed to be.

Despite the many attempts heretofore made, there remains a need for an interlocking panel construction that is easy to lock and which inhibits moisture penetration. More particularly, there remains a need for an interlocking panel design that is structurally simple so that it can be mass produced at low cost yet which is durable and effective.

The prior art, considered as a whole, neither teaches nor suggests to those of ordinary skill how the art of cabana panels could be further advanced.

DISCLOSURE OF INVENTION

The EPS core of a first edge of each panel is unsculpted but the second edge thereof has a pair of grooves formed therein along its extent.

Each of the respective metal skins that cover the top and bottom surfaces of each panel is bent ninety degrees at the unsculpted edge, in a direction towards the center of said panel. The next part is bent at an acute angle relative to the edge of the core in an opposite direction, i.e., back toward its associated top or bottom surface, and away from the unsculpted edge. That angled part terminates in a curved end; accordingly, an angled "J"-shaped connecting means is thereby formed. Due to its sheet metal construction, the connecting means is yieldable but resilient.

Each "J"-shaped connecting means is angled away from its counterpart, i.e., said means are disposed in diverging relation relative to one another.

Each of the respective metal skins that cover the opposite end of each panel is also bent ninety degrees at the sculpted edge of the panel as well, in a direction toward the center of the panel. Each skin then bends rearwardly and toward the center of the panel at an acute angle into its associated groove; each acutely bent section will hereinafter be referred to as a beveled section. Each beveled section terminates in a rounded section, hereinafter referred to as a cup, that is complemental to the curved end of the "J"-shaped part of the mating skin. The beveled section and cup are hereinafter collectively referred to as the ladle-shaped connecting means because of their collective appearance.

The ladle-shaped connecting means are disposed in converging relation relative to one another; like their counterparts, they are also yieldable and resilient.

When the novel modular panels are assembled into a roof, the curved end of each "J"-shaped connecting means first slidingly engages the beveled section of the ladle-shaped connecting means, and said beveled section guides each curved end into engagement with its associated cup. Since the metal skins are yieldable and resilient, the ladle-shaped part of each skin yields as the "J"-shaped part enters into engagement therewith, and each ladle-shaped part substantially resumes its original disposition after it has fully engaged its associated "J"-shaped part.

Since the diverging "J"-shaped connecting means mate with the converging ladle-shaped connecting means when the panels are assembled to form a roof, the connecting means oppose one another and provide a snap fit that ensures against facile separation of the panels.

This snap fit arrangement also forms a very tight seal that inhibits moisture penetration between the interlocked panels.

Thus, it is now apparent that the primary object of this invention is to provide interlocked EPS panels having a structural simplicity that enables their mass production at low cost but which provides a unique, biased interlocking means that holds interlocked panels together against facile separation.

Another important object is to provide panels that are strongly interlocked so that they cannot be separated easily.

Still another important object is to provide interlocking EPS panels where only one edge of each panel requires sculpting.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 3 is a side elevational view of facing skins only, i.e., with the EPS cores deleted to better depict said skins;

FIG. 4 is a view similar to FIG. 3, but showing how a pair of panels are interlocked;

FIG. 5 is an isometric view of a panel having a skin with the "J"-shaped connecting means; and FIG. 6 is an isometric view of a panel having a skin with the ladle-shaped connecting means.

BEST MODES FOR CARRYING OUT THE INVENTION

Figure 1:
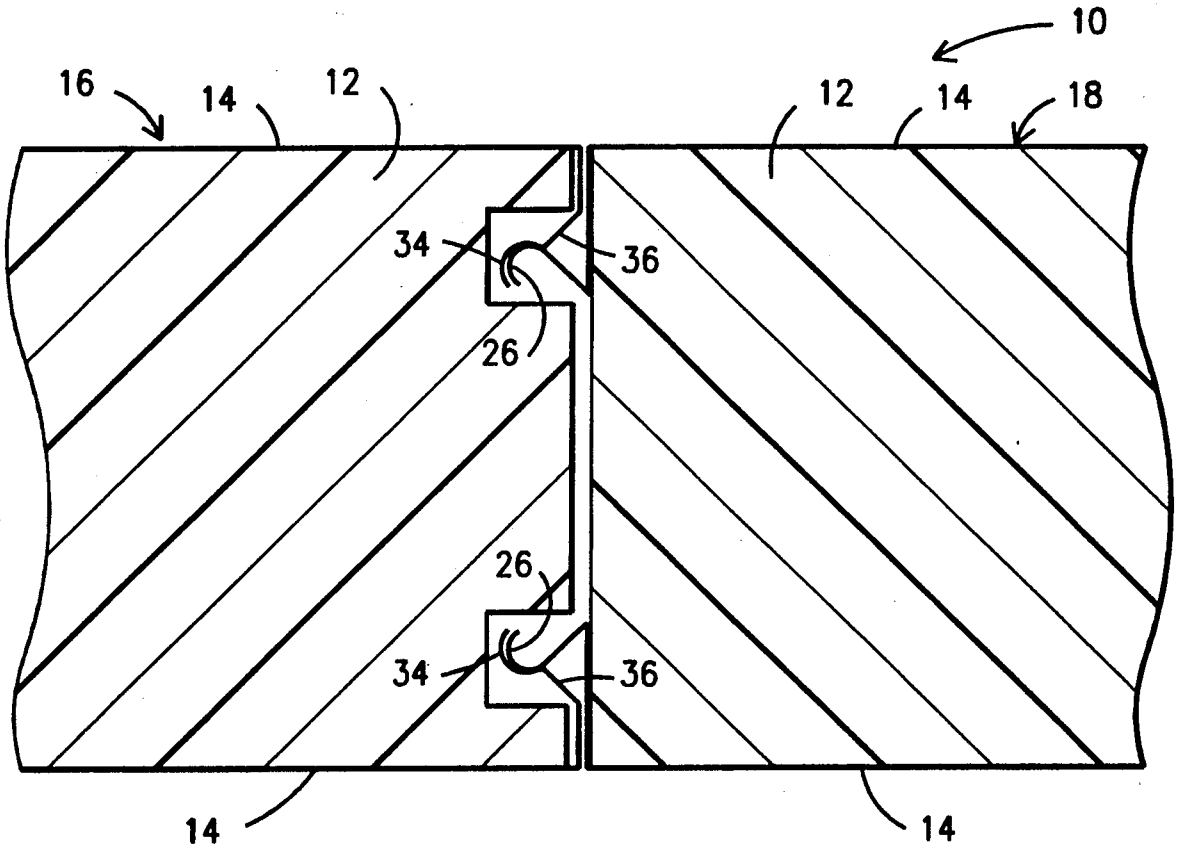
FIG. 1 is a cross sectional, side elevational view showing a pair of the novel panels in their interlocked configuration.

Referring now to FIG. 1, it will there be seen that a pair of edge-interlocked modular panels are denoted as a whole by the reference numeral 10.

Each panel has an EPS foam core 12, although cores other than EPS are within the scope of this invention. The core 12 of each panel is protected by a metallic skin 14 that overlies its top and bottom surfaces as shown; the skins are bonded to the top and bottom sides of the core by any suitable adhesive.

It should be understood from the outset that each panel has an edge that matches the edges shown in FIG. 1, i.e., panel 16 on the left side of FIG. 1 has an unillustrated opposite edge that has the same construction as the illustrated edge of panel 18 on the right hand side of FIG. 1, and panel 18 has an unillustrated edge that is sculpted to have the appearance of the illustrated edge of panel 16.

The gap shown in FIG. 1 between the panels 16 and 18 does not appear in real life; the drawing includes a gap just to better depict the construction of the novel parts.

Figure 2:
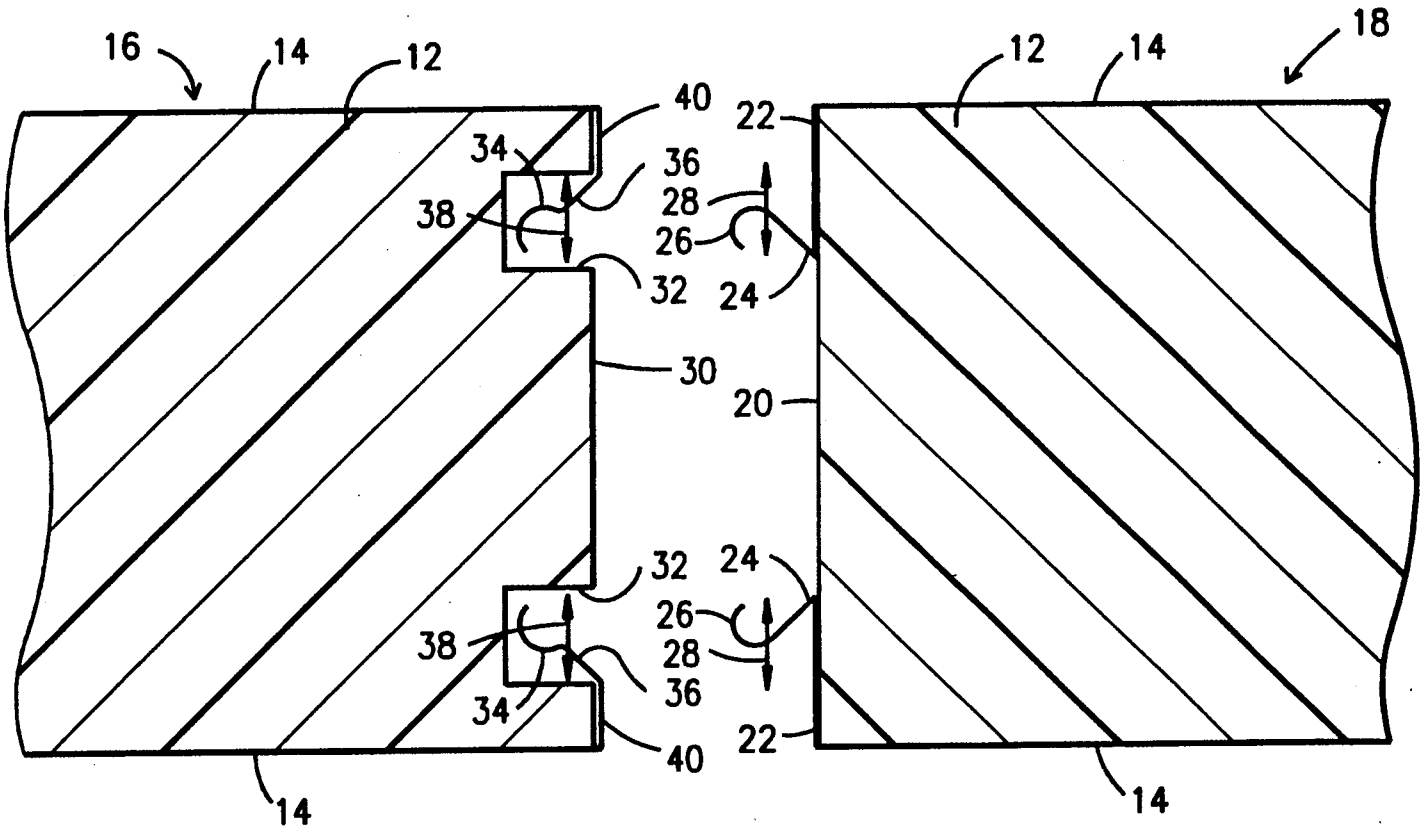
FIG. 2 is a cross sectional, side elevational view showing the panels of FIG. 1 in their spaced apart configuration.

An even clearer depiction of the novel parts is provided in FIG. 2. There it will be seen that top and bottom skins 14 of panel 18 are bent ninety degrees along the respective extents of their associated edge 20 of core 12, toward the center of the panel as illustrated. The skin 14 is then bent as shown to form an acute angle as at 24, and each angled, straight part 24 terminates in a curved end 26. Note that the angle between straight part 24 and flat panel edge 20 is about forty five degrees.

The "J"-shaped part of each skin (made up of parts 24 and 26) is yieldable and resilient, i.e., if said parts are displaced in either direction in the plane of the paper as indicated by the double-headed directional arrows 28, they will return to their illustrated position of repose because they are self-biasing, i.e., resilient. Moreover, if held in a position where they are unable to resume their respective positions of repose, their self-biasing aspect will continually urge them to return to said position of repose.

It is also noted that although the angle of each straight part 24 with respect to the edge of the panel is called an acute angle, said angled position is achieved by bending the skin 14 through an obtuse angle.

Note also that the "J"-shaped part associated with the skin 14 that covers the top side of panel 18 extends away from edge 20 and upwardly toward the top side of the panel; similarly, the "J"-shaped part associated with the skin 14 that overlies the bottom side of panel 18 extends away from edge 20 and downwardly toward the bottom side of the panel. Thus, each "J"-shaped part extends away from flat edge 20 and is disposed in diverging relation relative to the opposing "J"-shaped part.

Note that edge 20 of panel 18 is flat, i.e., unsculpted; this is an important feature of this invention. The simple bends required to produce the "J"-shaped connecting means and the simplicity inherent in not sculpting edge 20 results in a panel construction that is very inexpensive to manufacture.

Reference is now made to the left half of FIG. 2. Edge 30 thereof is sculpted; more particularly, a pair of parallel square channel grooves 32 are formed therein along its extent, each groove being disposed in equidistantly spaced relation to its associated top or bottom surface and in equidistantly spaced relation to the center of the panel.

Each groove 32 accommodates the inwardly extending, ladle-shaped connecting means of skin 14, i.e., rounded or cup-shaped part 34 and beveled part 36 of each skin extends into its associated groove. These parts are yieldable and resilient and will resume their depicted positions of repose if displaced in the plane of the paper as indicated by the double-headed directional arrows 38. Each skin 14 is first bent ninety degrees toward the center of its associated panel to overlie edge 30 as at 40, is bent a second time to form straight beveled part 36, and a third time to form the rounded part 34. Thus, the inwardly extending part has the appearance of a ladle.

Note the converging relation between the opposing ladle-shaped members and the forty five degree angular relation between each straight beveled part relative to panel edge 30.

FIG. 1 can now be better understood; note that when panel edges 20 and 30 are placed into abutting relation to one another, the cup-shaped part 34 of each ladle-shaped part receives the curved end 26 of its associated "J"-shaped part. Advantageously, the respective angular bends formed in the outwardly extending "J"-shaped parts and their complemental inwardly extending parts are preselected so that both of said parts are driven out of their respective positions of repose when they are interlocked with one another. Thus, the resiliency of each part urges it to regain its position of repose and this urging ensures a strong interconnection between the abutting panel edges, thereby attaining an important object of this invention.

Beveled parts 36 of the inwardly extending, ladle-shaped parts play the important role of guiding curved ends 26 into rounded ends 34, as perhaps best understood from the animation provided by FIGS. 3 and 4.

The forty five degree disposition of the beveled parts 36 and the forty five degree disposition of the "J"-shaped connecting means enables facile connection of contiguous panel edges. Moreover, since the yieldability of the confronting connecting means is about the same due to their common angular orientation, neither connecting means will need to bend more than the other. This provides several mechanical advantages, including ensuring that the elastic limit of each yieldable member will not be exceeded.

Moreover, the outwardly extending disposition of the "J"-shaped connecting means and the inwardly or reversely extending disposition of the ladle-shaped connecting means provides still further mechanical advantages. The housing of both of said connecting means in their associated grooves when they are releasably engaged to one another as depicted in FIG. 1 is also advantageous.

FIG. 4 indicates that the panels are interlocked by tilting one of the panels at an angle with respect to its mating panel, followed by rotation of the tilted panel as denoted by directional arrow 50 until the configuration of FIG. 1 is achieved.

FIGS. 5 and 6 provide isometric views of the mating skins.

The juxtaposition of diverging and converging yieldable and resilient connecting means disposed at a common, complementary angle with respect to one another and having a "J"-shaped and a ladle-shaped configuration, respectively, and the benefits derived therefrom, were heretofore unknown, anywhere in the world.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A modular panel of the type having a core formed of a preselected material and a first and second thin metal skin bonded to the top and bottom surfaces of said core, respectively, comprising:

a first panel edge that is flat;

a second panel edge that is sculpted;

said sculpted panel edge having a pair of parallel grooves formed therein;

each of said first and second skins having a first end with a ninety degree bend formed therein at said first panel edge, said respective bent skins overlying at least in part said first panel edge;

each of said first and second metal skins having a "J"-shaped connecting means formed in the respective first ends thereof, integral with said respective ninety degree bends, that projects outwardly at a first predetermined angle with respect to said flat panel edge and away from a center of said panel;

each of said "J"-shaped connecting means having a straight part that is bent at said first predetermined angle relative to said flat panel edge and further having a curved end integral with said straight part;

each of said "J"-shaped connecting means having a preselected position of repose to which it returns when displaced therefrom by an externally-imparted force;

said "J"-shaped connecting means being disposed in diverging relation relative to one another;

each of said first and second metal skins having a second end and each of said skins at said second end having a ninety degree bend formed therein to at least in part overlie said second panel edge;

each second end of said first and second metal skins having a ladle-shaped inwardly extending connecting means that extends into and which is accommodated by an associated groove formed in said second panel edge;

each of said ladle-shaped connecting means having a straight beveled part that is disposed at a second predetermined angle relative to said second panel edge and a cup-shaped part integrally formed therewith;

each of said ladle-shaped connecting means having a preselected position of repose to which it returns when displaced therefrom by an externally imparted force; and each of said ladle-shaped connecting means being disposed in converging relation relative to one another;

whereby a pair of contiguous panel edges are interlocked to one another by positioning the curved end of each "J"-shaped connecting means into the cup-shaped part of each ladle-shaped connecting means, said positioning displacing said "J"-shaped and said ladle-shaped connecting means from their respective positions of repose so that a bias inherent in each of said connecting means holds them in their interlocked relation.

2. The panel of claim 1, wherein said first and second predetermined angles are equal to one another.

3. The panel of claim 2, wherein said first and second predetermined angles are about forty five degrees.

4. The panel of claim 3, wherein each of said grooves has a square "U" shape.

5. The panel of claim 4, wherein said "J"-shaped connecting means and said ladle-shaped connecting means are housed within said grooves when contiguous panels are interconnected to one another.

6. The panel of claim 5, wherein the preselected material of said core is expanded polystyrene.

* * * * *